US005535455A

United States Patent [19]

Liu

[11] Patent Number: 5,535,455

[45] Date of Patent: Jul. 16, 1996

[54] SINK STRAINER FOR GARBAGE DISPOSAL UNIT

[75] Inventor: Morgan C. Liu, Taoyuan, Taiwan

[73] Assignee: Enlight Corporation, Taiwan

[21] Appl. No.: 429,058

[22] Filed: Apr. 26, 1995

[51] Int. Cl.[6] ..... A47K 1/14; E03C 1/26

[52] U.S. Cl. ..... 4/287; 4/286; 4/290

[58] Field of Search ..... 4/286, 287, 288, 4/289, 290, 292, 295

[56] References Cited

U.S. PATENT DOCUMENTS

| | | | |
|---|---|---|---|
| 2,278,566 | 4/1942 | Schaible | 4/287 X |
| 4,320,540 | 3/1982 | Leavens | 4/287 |
| 5,265,281 | 11/1993 | McAlpine | 4/287 |
| 5,369,815 | 12/1994 | Martin | 4/287 |
| 5,418,983 | 5/1995 | Garguillo et al. | 4/287 |

*Primary Examiner*—Robert M. Fetsuga
*Attorney, Agent, or Firm*—Ladas & Parry

[57] ABSTRACT

A sink strainer for a garbage disposal unit includes a strainer unit, a seat and a mounting flange. The strainer unit includes a handle, a strainer member and a plug member. The plug member has a platform and a surrounding wall depending from the platform on which multiple slope guide are located. The seat includes a limiter located at a lower portion of the seat, a stopping surface protruding from and surrounding a middle portion of the seat, a snapping portion at a top of the seat, and another snapping portion at a bottom of the seat. The mounting flange is provided at a top end with a flange portion and at a bottom end with a mounting portion. The sink strainer may further include a decorative flange having a flange portion and a snapping portion which are dimensioned and configured to abut on, and be engaged with, the flange portion and top snapping portion of the seat.

8 Claims, 5 Drawing Sheets

SINK STRAINER FOR GARBAGE DISPOSAL UNIT

FIELD OF THE INVENTION

The present invention relates to a sink strainer for garbage disposal unit, and particularly to a sink strainer comprising a strainer unit, a seat and a mounting flange, and still particularly to a sink strainer further comprising a decorative flange.

BACKGROUND OF THE INVENTION

Conventionally, sink strainers for garbage disposal unit are various in structure. A sink usually has two straining holes one for mounting with a garbage disposal unit, and the other for drainage only, wherein the former hole needs a plug as a stopper and the latter uses a strainer. However, using the plug still encounters setbacks such as when pulling off the plug, spoons or forks will drop into the garbage disposal unit causing damage thereto. Therefore, stoppers having also a function of strainer were developed. One of the examples may be found in U.S. Pat. No. 5,265,281 which discloses a stopper for garbage disposal unit inlets. The prior stopper comprises a side wall defining a bore and carrying an external sealing member for releasably engaging the inner face of the bore of an existing sink flange, an upper flange extending radially outwardly from an upper end of the side wall for covering the upper face of the existing sink flange, a strainer member extending across the bore and a lower wall extending across the bore below the strainer member and including a plug member movable between a sealing position and an open position in which fluid may drain through the stopper. A plug operating member extends upwardly from the plug member and through the strainer member to allow the plug member to be lifted to the open position.

In this prior art, it is necessary to take the whole unit out in order to introduce garbage into the disposal unit. Obviously, such operation is inconvenient.

SUMMARY OF THE INVENTION

An object of the present invention is to provide a sink strainer for garbage disposal unit, comprising a strainer unit, a seat and a mounting flange, where the strainer unit can be taken out easily by simply turning the strainer unit to disengage the slope guide and the limiter.

Still another object of the present invention is to provide a sink strainer for garbage disposal unit, further comprising a decorative flange so that the user can readily select and mount to the stainer a decorative flange bearing a color may more fit the color of the sink or to meet the desireness of the user.

Generally speaking, the sink strainer according to the present invention comprises a strainer unit, a seat and a mounting flange. The strainer unit includes a handle, a strainer member and a plug member. The handle has a foot. The strainer member has a plurality of openings spaced equi-distantly from one another around the strainer member, and a central hole. The plug member has a platform, a surrounding wall depending from the platform, on which multiple slope guides are located and are equi-distantly spaced from one another, and a stem upright from the center of the plug member. In assembling the strainer unit, the stem of the plug member passes through the central hole of the strainer member and is tightly engaged with the foot of the handle so that the handle, the strainer member and the plug member become one single strainer unit. The seat includes a limiter located at the lower portion of the seat, a stopping surface protruding from and surrounding the middle portion of the seat, a snapping portion at the top of the seat, and another snapping portion at the bottom of the seat. The mounting flange is provided at its top with a flange portion and at its bottom with a mounting portion. In assembly, the surrounding wall of the plug member is received to and abuts on the stopping surface, and the limiter inserts into one of the slope guides, so that when turning of the plug member the plug member will be forced to go up or down and for the latter case, the seal ring of the plug member will abut on the stopping surface resulting from a closed status, while turning of the plug member in a counter direction, the plug member will go up producing a gap between the seal ring of the plug member and the stopping surface of the seat and thus resulting from an opened status. Removing the strainer unit to introduce garbage into the disposal unit can be achieved by simply turning the strainer unit to disengage the slope guide and the limiter. The sink strainer may further comprises a decorative flange having a flange portion and a snapping portion, which are dimensioned and configured to abut on, and be engaged with, the flange portion of the mounting flange and the snapping portion of the seat. The decorative flange is readily selected and mounted into the strainer by having a color more conformed with the color of the sink to be incorporated therewith or more desirable to the user.

BRIEF DESCRIPTION OF THE DRAWINGS

These and other objects, advantages and features of the present invention will be more fully understood and appreciated, by reference to the written specification.

DETAILED DESCRIPTION OF THE INVENTION

Figure 1:
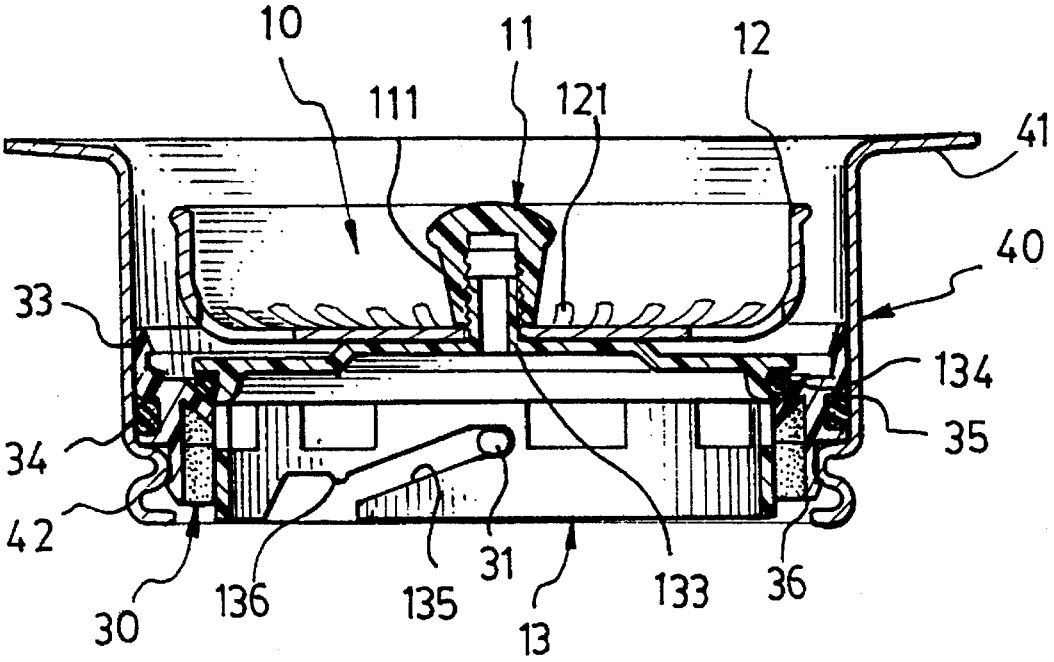
FIG. 1 is a cross-sectional view of the present invention showing that the strainer unit is in a closed status with the seat.
Figure 2:
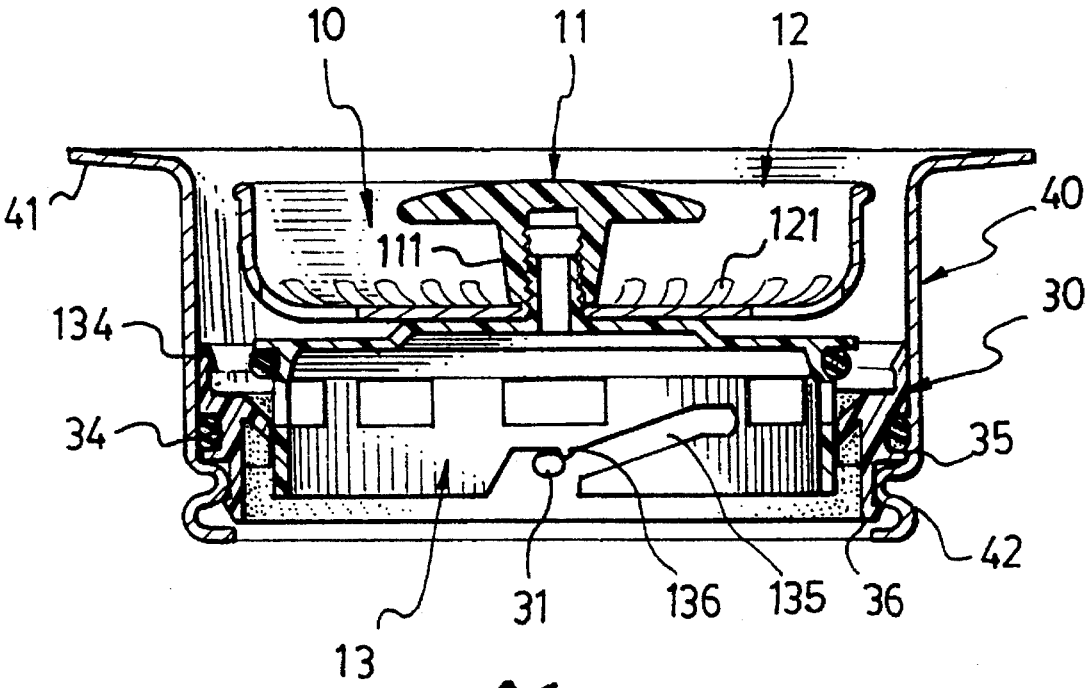
FIG. 2 is a cross-sectional view of the present invention showing that the strainer unit is in an opened status with the seat.
Figure 3:
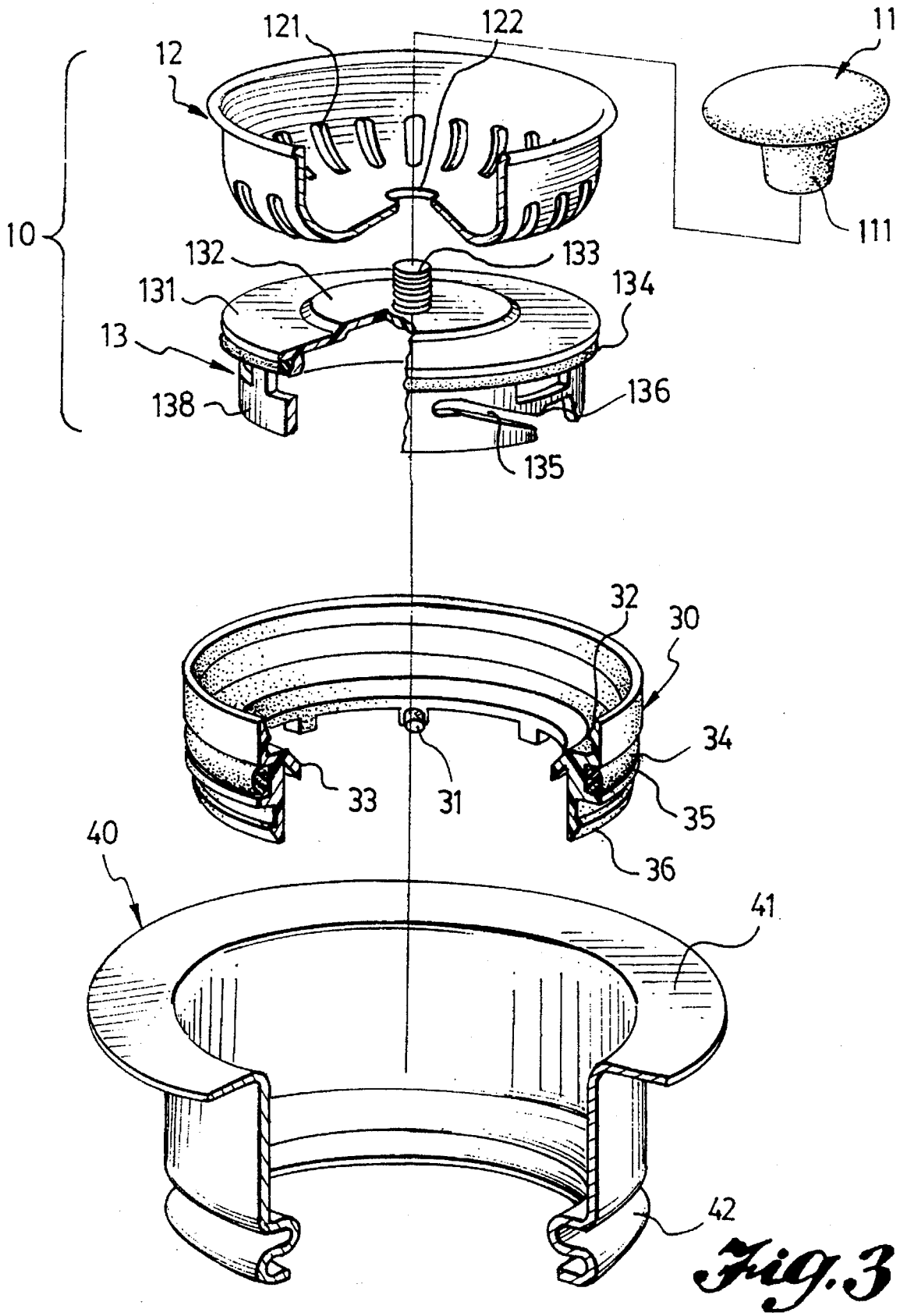
FIG. 3 is an exploded view of the present invention.

Referring to FIGS. 1, 2 and 3, the sink strainer according to the present invention comprises a strainer unit 10, a seat 30 and a mounting flange 40. The strainer unit 10 includes a handle 11, a strainer member 12 and a plug member 13. The handle 11, being of flat oval, has a foot 111 inside of which interior thread is provided. The strainer member 12, being of circular-basket shape, has a plurality of openings 121 spaced equi-distantly from one another around the strainer member 12, and a central hole 122. The plug member 13 has a platform 131 of circular flatness, a surrounding wall 138 depending from the platform 131, on which multiple slope guides 135 are located and are equidistantly spaced from one another, and a stem 133 having exterior thread and upright from the center of the plug member 13. A seal ring 134 is provided underneath the platform 131 and surrounding the top of the surrounding wall 138. In the present embodiment of the invention, the number of the slope guides 135 are three departing from one another in 120 degrees. The slope guide 135 is provided with a protrusion 136 at its upper side. In assembling the strainer unit 10, the stem 133 passes through the central hole 122 and is screwingly engaged with the foot 111 so that the handle 11, the strainer member 12 and the plug member 13 become one single strainer unit 10. On the platform 131 a protruded plane 132 is provided with on which the strainer member 12 is seated.

The seat 30 includes a protruded limiter 31 located at the lower portion of the seat 30, a stopping surface 33 protruding from and surrounding the middle portion of the seat 30, a snapping portion 32 formed at the top of the seat 30, and another snapping portion 36 at the bottom of the seat 30. A groove 35 is provided at the exterior of the seat 30 for receiving a seal ring 34.

The mounting flange 40 is provided at its top with a flange portion 41 adopted to be incorporated with a conventional sink, and at its bottom with a mounting portion 42.

In assembly of the sink strainer according to the present invention, the surrounding wall 138 is received to and abuts on the stopping surface 33, and the limiter 31 inserts into one of the slope guides 135, so that when turning of the plug member 13 it will be force to go up or down and for the latter case, the seal ring 134 will abut on the stopping surface 33 resulting from a closed status (as shown in FIG. 1), while turning of the plug member 13 in a counter direction, the plug member 13 will go up and the limiter 31 is then forced to go over the protrusion 136 and retarded thereby for maintaining in position, producing a gap between the seal ring 134 and the stopping surface 33, and thus resulting from an opened status (as shown in FIG. 2) making drainage possible. Removing the strainer unit 10 to introduce garbage into a conventional disposal unit 50 can be achieved by simply by turning the strainer unit 10 to disengage the slope guide 135 and the limiter 31.

Figure 4:
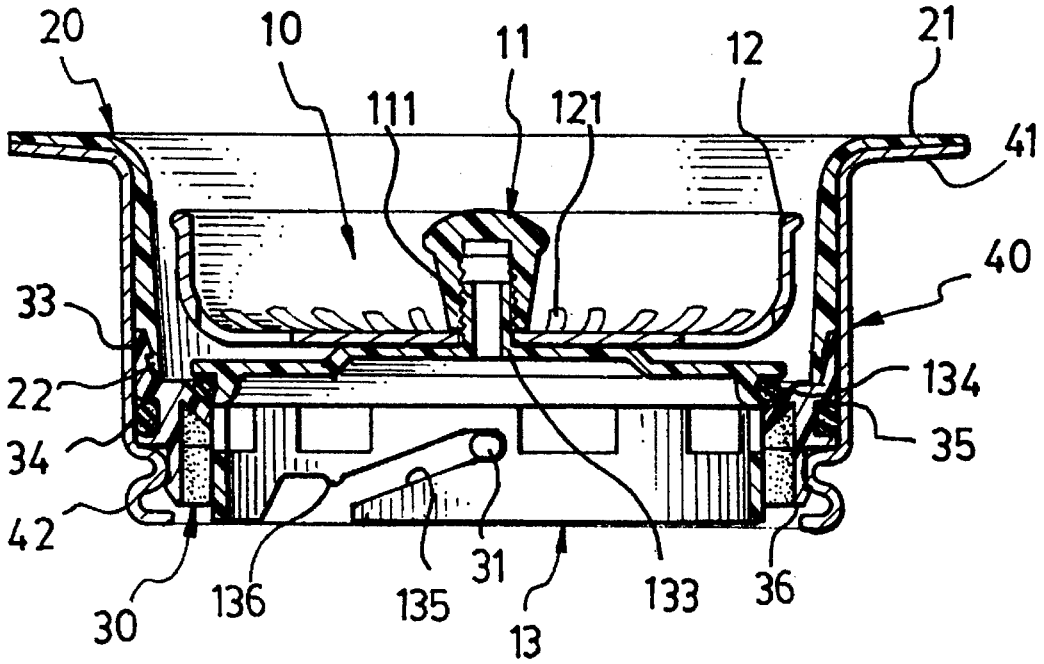
FIG. 4 is a cross-sectional view of another embodiment of the present invention, with the decorative flange added, showing that the strainer unit is in a closed status with the seat.
Figure 5:
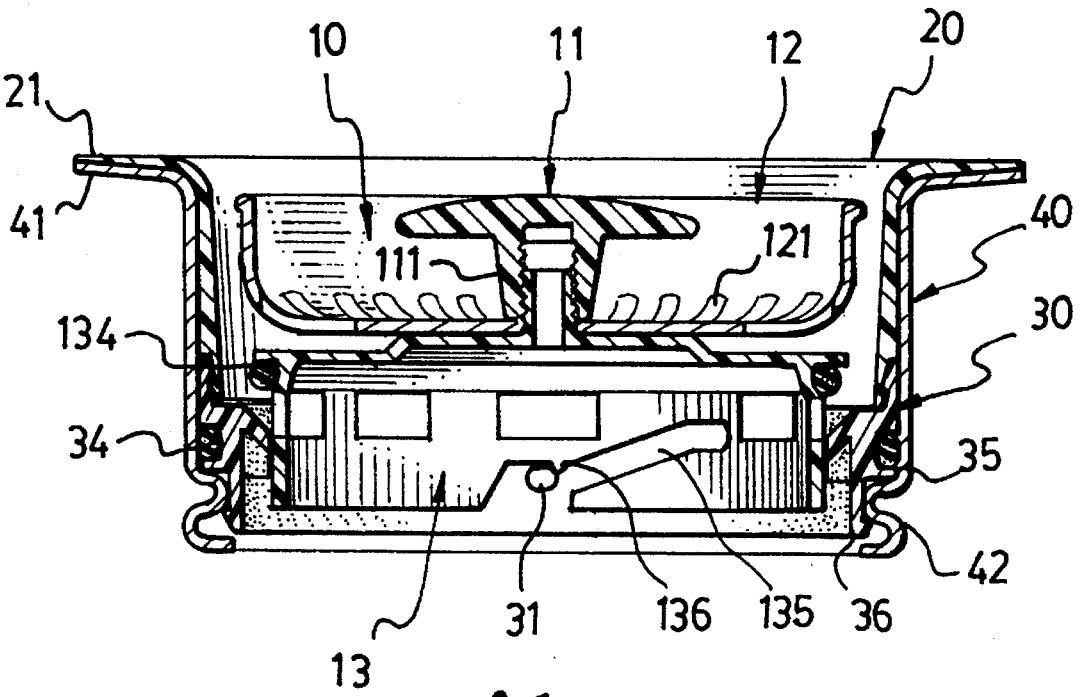
FIG. 5 is a cross-sectional view of another embodiment of the present invention, with the decorative flange added, showing that the strainer unit is in an opened status with the seat.
Figure 6:
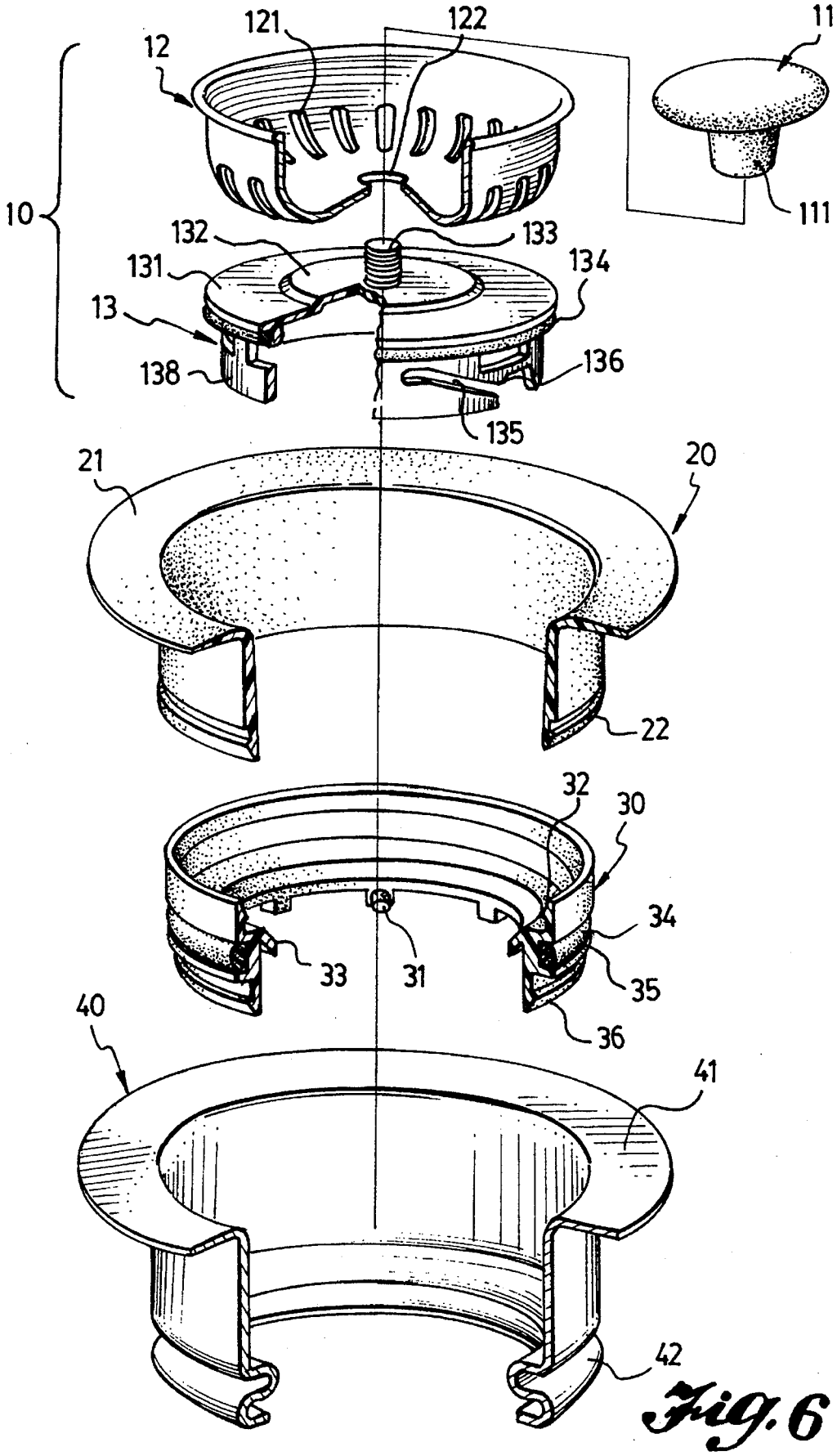
FIG. 6 is an exploded view of the present invention, with the decorative flange added.

As shown in FIGS. 4 to 6, another embodiment of the present invention, the sink strainer may further comprises a decorative flange 20 having a flange portion 21 and a snapping portion 22, which are dimensioned and configurated to abut on, and be engaged with, the flange portion 41 and the snapping portion 32. The decorative flange 20 is readily selected and mounted into the strainer by having a color more conformed with the color of the sink to be incorporated therewith or more desirable to the user.

Figure 7:
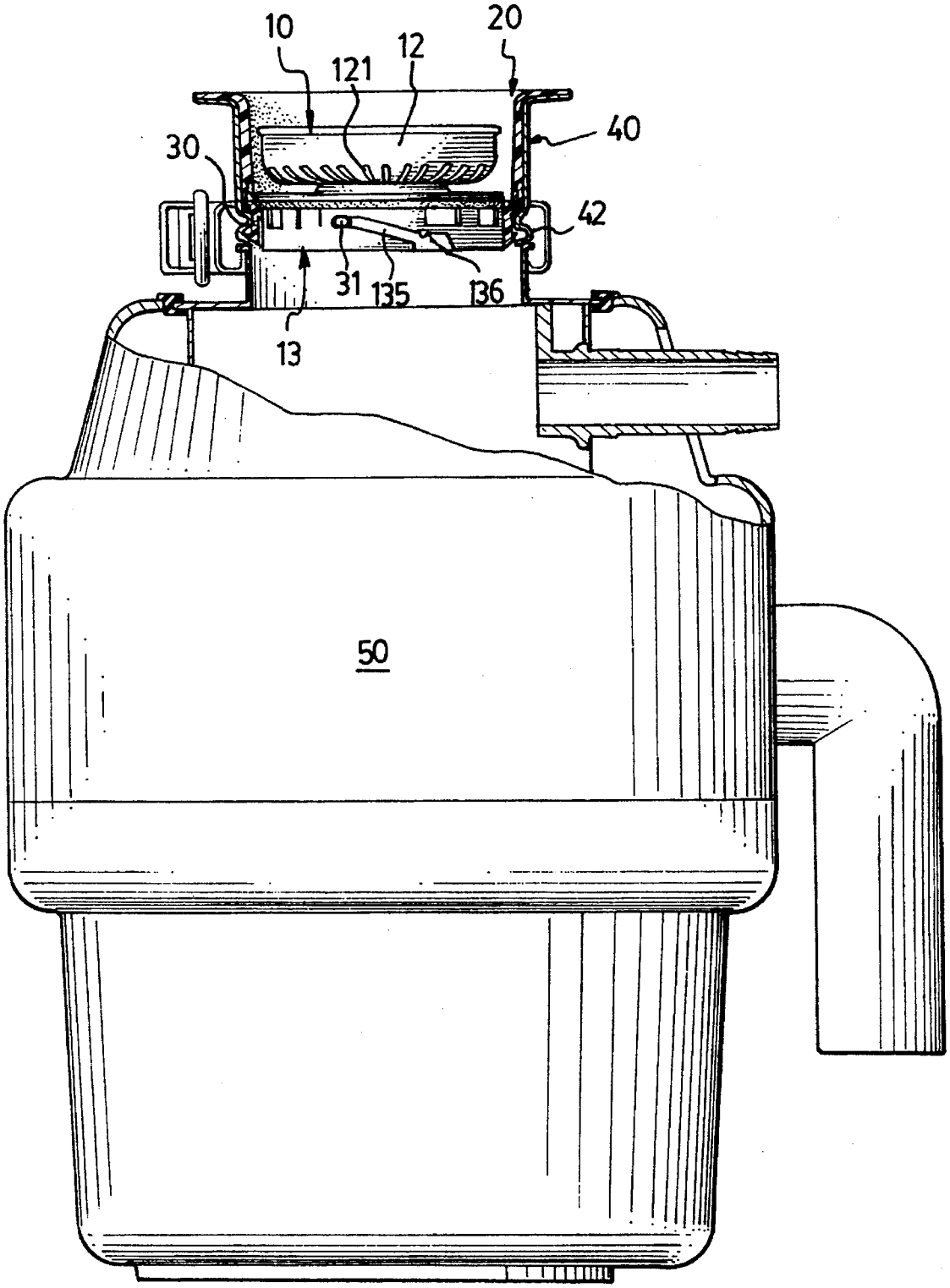
FIG. 7 is a schematic view of the present invention, with the decorative flange added, in corporation with a conventional garbage disposal unit.

In FIG. 7, the sink strainer according to the second embodiment of present invention is mounted to the conventional garbage disposable unit 50 by engaging it with the mounting portion 42 of the mounting flange 40.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sink strainer for a garbage disposal unit, comprising:

a strainer unit, including a stainer member and a plug member which are secured together by a handle, where the strainer member has a plurality of openings, and the plug member has a platform and a surrounding wall depending from the platform, and at least one slope guide provided on the surrounding wall;

a seat, including a limiter located at a lower portion of the seat, a stopping surface protruding from and surrounding a middle portion of the seat, a snapping portion at a top of the seat and another snapping portion at a bottom of the seat; and a mounting flange, including a flange portion adapted to be incorporated with a conventional sink, and a mounting portion adapted to be incorporated with the garbage disposal unit.

2. The sink strainer according to claim 1, wherein the strainer member has a central hole, and the plug member has a stem upright from a center of the plug member, and going through the central hole, the stem is engaged with a foot of the handle.

3. The sink strainer according to claim 1, wherein the plug member is formed with a protruded plane on the platform, on which the strainer member is seated.

4. The sink strainer according to claim 1, wherein the slope guide is provided with a protrusion at an upper side, and going over the protrusion the limiter can be maintained in position.

5. The sink strainer according to claim 1, further comprising a seal ring provided underneath the platform and surrounding the top of the surrounding wall.

6. The sink strainer according to claim 1, wherein a groove is provided at an exterior of the seat.

7. The sink strainer according to claim 6, further comprising a seal ring adapted to be received in the groove.

8. A sink stainer for a garbage disposal unit, comprising:

a strainer unit, including a stainer member and a plug member which are secured together by a handle, where the strainer member has a plurality of openings, and the plug member has a platform and a surrounding wall depending from the platform, and at least one slope guide provided on the surrounding wall;

a seat, including a limiter located at a lower portion of the seat, a stopping surface protruding from and surrounding a middle portion of the seat, a snapping portion at a top of the seat and another snapping portion at a bottom of the seat;

a mounting flange, including a flange portion adapted to be incorporated with a conventional sink, and a mounting portion adapted to be incorporated with the garbage disposal unit; and a decorative flange, including a flange portion and a snapping portion, which are dimensioned and configured to abut on, and be engaged with, the flange portion of the mounting flange and the snapping portion at the top of the seat.

* * * * *